United States Patent [19]

Faulconer et al.

[11] Patent Number: 4,694,772

[45] Date of Patent: Sep. 22, 1987

[54] DIVER'S BUOYANCY COMPENSATOR BELT

[75] Inventors: Mark Faulconer, Costa Mesa; Scott E. Greatrake, Fountain Valley, both of Calif.

[73] Assignee: U.S.D. Corp, Santa Ana, Calif.

[21] Appl. No.: 745,492

[22] Filed: Jun. 17, 1985

[51] Int. Cl.[4] ..... B63C 9/24

[52] U.S. Cl. ..... 114/315; 405/185; 441/116; 441/112; 128/202.14

[58] Field of Search ..... 441/106, 108, 111–116, 441/96, 123; 114/315; 128/202.14; 2/2.1 R; 405/185, 186

[56] References Cited

U.S. PATENT DOCUMENTS

| | | | |
|---|---|---|---|
| 2,905,954 | 9/1959 | Lanciano, Jr. | 441/116 |
| 3,470,570 | 10/1969 | Christiansen | 405/186 |
| 3,877,098 | 4/1975 | Braly | 405/186 |
| 4,054,132 | 10/1977 | Deeds | 114/315 |
| 4,137,585 | 2/1979 | Wright, III | 441/116 |
| 4,440,525 | 4/1984 | Perla | 405/186 |

FOREIGN PATENT DOCUMENTS

| | | | |
|---|---|---|---|
| 3175 | of 1868 | United Kingdom | 405/186 |

*Primary Examiner*—Jeffrey V. Nase

*Assistant Examiner*—Edwin L. Swinehart

*Attorney, Agent, or Firm*—George F. Bethel; Patience K. Bethel

[57] ABSTRACT

A diver's buoyancy compensator belt to be used with a diver's buoyancy compensator of the type that allows for increases and decreases of air to be provided thereto, depending upon the amount of buoyancy that is required. The buoyancy compensator belt has a first belt made of webbing for attachment to a buoyancy compensator and a backpack that in turn receives a tank connected thereto. The buoyancy compensator belt retains the buoyancy compensator around a diver's waist at distinct locations to allow for movement thereof which allows for the belt to expand and contract, due to the belt being made from an elastomeric material. The elastomeric material allows for a stretching and contraction of the belt, due to various pressure conditions and can be made of elastomeric foam having discrete cells therein. As the belt expands and contracts due to the discrete cells being pressurized at various depths, it compensates for the depth. This provides for overall control of the belt that is accommodated for at various depths so that the belt can expand and contract commensurately with wetsuits underlying the belt that are also made of foamed elastomeric cellular material.

6 Claims, 5 Drawing Figures

DIVER'S BUOYANCY COMPENSATOR BELT

BACKGROUND OF THE INVENTION

The background of this invention is within the diving art. More particularly, it resides within the art of providing a diver with a buoyancy compensator and an attachment for the buoyancy compensator to a diver. The attachment is particularly oriented for use with the diver at various depths to compensate for pressure variances at such depths. In addition thereto, it allows for complementary expansion and contraction when used in conjunction with a wetsuit made of foam cellular material.

THE PRIOR ART

The prior art with regard to buoyancy compensator belts involved the utilization of a buoyancy compensator having looped openings therein that receive a belt. The belt wrapped around the user at the front and was held in place by a buckle.

The belt could be stitched or attached to the buoyancy compensator through the looped configuration in any suitable manner. After the user initially adjusted the belt, it was found to be uncomfortable at various depths. This was due to the fact that the belt was made of webbing and did not expand and contract with regard to the diver's depth and attendant pressure on the belt and buoyancy compensator.

Other attachment means for buoyancy compensators were configured to incorporate weight belts and securement means that attached the buoyancy compensator around a user's waist with combination units, including the weight belt and the other attachment means. In all of the prior art, the attachment means generally incorporated a web or non-expandable attachment for coupling the buoyancy compensator to a user's waist. The adjustment of the distance around a user's waist was accommodated for by means of a buckle that could adjust the circumference of the belt as it extended around a user's waist. This could be an overcenter buckle, a frictional buckle, a snap buckle, or any other suitable means in connected relationship to the buckle.

The Applicants herein have found that a comfortable means for attaching a buoyancy compensator can be formed of elastomeric material. The elastomeric material can be in the form of a foamed elastomer, a stretchable elastomeric wrap with air pockets, or a belt made of the same material as wetsuit material, which is generally a foamed elastomer such as neoprene rubber that has a fabric adhered to one or both sides thereof.

The foregoing belt is attached to a buoyancy compensator by means of the loops of the buoyancy compensator that normally are connected to a webbed belt. The substitution of the webbed belt or other attachment means by the buoyancy compensator belt of this invention allow for a connection of the buoyancy compensator and attendant expansion and contraction of the elastomeric buoyancy compensator belt with sufficient connection to the buoyancy compensator. This permits the buoyancy compensator to be attached to the diver without restricting the diver through a pre-established web tightened attachment of the buoyancy compensator to the user.

The foregoing allows for the expansion and contraction of the buoyancy compensator belt, or foamed elastomeric portion commensurate with the expansion and contraction of the wetsuit material which a diver is using. Furthermore, even if a diver is not using any type of wetsuit, but merely has the belt around him, the expansion and contraction by virtue of the cellular or elastomeric material of the belt provides for adequate compensation of the changes in diameter and the particular changes in circumference of the belt based upon the various changes of pressure as a diver dives deeper or comes to lesser depths.

SUMMARY OF THE INVENTION

In summation, this invention comprises a buoyancy compensator belt for a diver that can expand and contract based upon the various depths at which a diver dives into the water.

More particularly, the buoyancy compensator belt has an attachment belt or other securement means for attachment of the buoyancy compensator belt to a buoyancy compensator. The buoyancy compensator belt itself is made of an elastomer and wraps around a diver's waist to provide for attachment of the buoyancy compensator around a diver's waist.

The buoyancy compensator belt of the invention is made from an elastomeric material. The elastomeric material can be made with a cellular foam structure, such as a wetsuit foamed elastomeric material having a backing material laminated thereto. Thus, the belt expands and contracts commensurate with the expansion and contraction of the wetsuit of a diver in an analogous manner. In this manner, the belt allows for variances of pressure and changes in depth so that a user is not constricted with a fixed belt circumference, but rather the buoyancy compensator belt compensates for variances in depths.

The foregoing compensation through the elastomeric or foamed elastomeric means is a substantial step over the art and allows for a usage by a diver of a buoyancy compensator in a preferred and more comfortable manner.

BRIEF DESCRIPTION OF THE DRAWINGS

The invention will be more clearly understood by reference to the description below taken in conjunction with the accompanying drawings.

DESCRIPTION OF THE PREFERRED EMBODIMENTS

Figure 1:
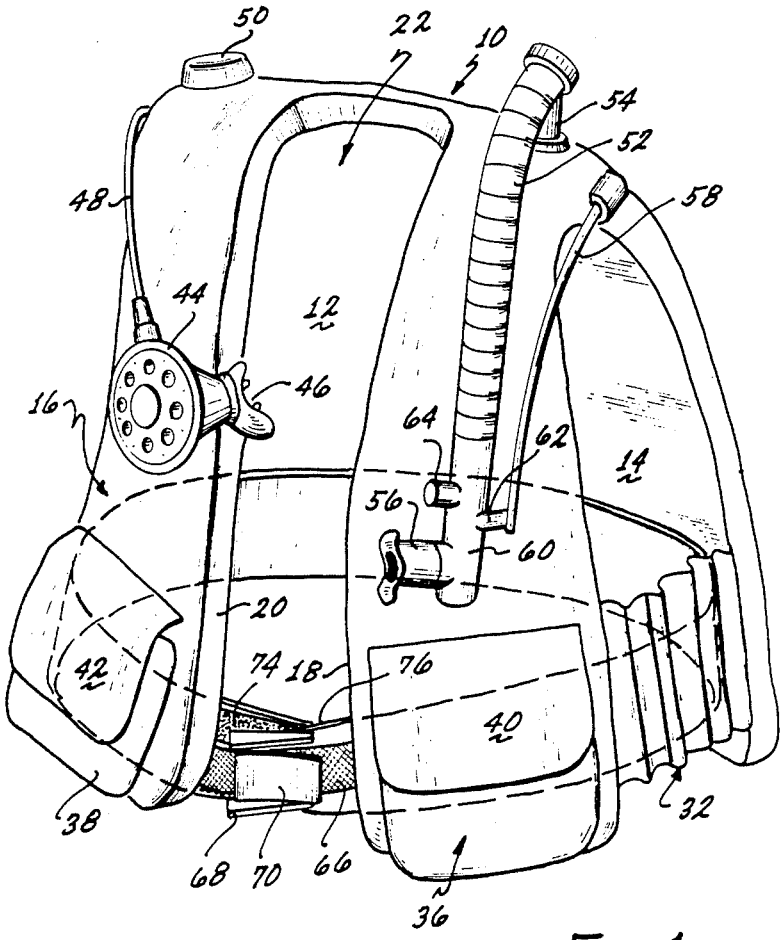
FIG. 1 shows the buoyancy compensator of this invention with a buoyancy compensator belt therewith.
Figure 5:
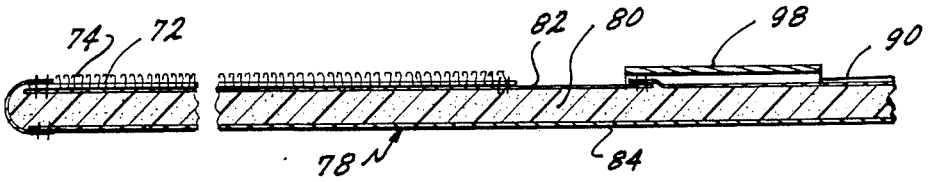
FIG. 5 shows a sectional view that has been fragmented in part of the buoyancy compensator belt attachment means in the direction of lines 5—5 of FIG. 4.

Looking at FIG. 1, it can be seen that a buoyancy compensator 10 has been shown. The buoyancy compensator 10 is made from a vest-like configuration having a frontal opening 12 and two side openings 14, and 16 which is hidden from the view.

The buoyancy compensator 10 has a left vest area and a right vest area which covers the frontal portion of a user. For purposes of convention, the left and right vest areas shall be considered those as worn by a user that are designated as left vest area or panel 18 and right vest area of panel 20.

On the back of the buoyancy compensator, a major back cover area or panel 22 is provided which can be segmented and divided in any particular manner to accommodate the invention hereof.

For purposes of designating the two respective portions, a left back area or panel 24 and a right back area or panel 26 have been designated with the convention of being worn on the left and right side respectively of a user. These two respective back areas 24 and 26 have a backpack unit 28 therebetween.

The buoyancy compensator 10 and backpack unit 28 can be seen in various showings, including the assignee's catalog bearing a copyright of 1984. In addition thereto, a description of the buoyancy compensator can be seen in application Ser. No. 461,180, filed Jan. 26, 1983 now U.S. Pat. No. 4,523,914 which issued June 18, 1985.

The backpack 28 generally comprises a frame member made of a blow molded plastic that has a band member 30 passing therethrough. The band member 30 passing therethrough receives a breathing gas tank connected therewith. The breathing gas tank which has not been shown passes upwardly behind the buoyancy compensator back portion 22 and generally protrudes up above the area of a user's back.

In addition thereto, the backpack oftentimes has a non-stretchable webbed belt connected thereto which circumscribes a user's waist. It is this particular belt which is utilized with a backpack and buoyancy compensator that the applicant's invention is directed at in order to eliminate such prior art belts.

Looking more particularly again at the buoyancy compensator 10, it can be seen that the left panel or vest area 18 and right vest area or panel 20 are joined to the left back panel 24 and right back panel 26 by means of an elastic webbing side panel 32 on the left side and 34 on the right side. The webbing side panels 32 and 34 are made of a folded or pleated material which has an elastomeric material to allow it to expand around a user's waist.

On the left front vest area and the right front vest area or panels 18 and 20 respectively, a pair of pockets 36 and 38 are shown. The respective left and right pockets 36 and 38 have flaps 40 and 42 thereover. The flaps 40 and 42 overlie spaces or openings for receiving diving equipment that can be implaced therein, such as a regulator as shown in FIG. 1.

As can be seen, a regulator which is a second stage regulator 44 is shown. The second stage regulator 44 has a mouthpiece 46 which a user breathes through and is connected by means of a tube 48 to a first stage regulator that is attached to a tank that is not shown. The tank is attached to the backpack by means of a band 30.

The vest incorporates a dump valve or safety valve encapsulated within a housing 50. The vest furthermore includes an inflator tube 52. The inflator tube 52 is an oral inflator tube that is connected by a fitting 54 to the interior bladder of the buoyancy compensator. The fitting 54 allows for a coupling of the inflator tube 52 so that one can breathe through a mouthpiece 56 for the inflator tube and fill the vest orally through the mouthpiece 56.

In addition thereto, the buoyancy compensator can be filled by means of a supply of gas from the breathing gas tank that is delivered through a tube 58 that can be referred to as a power inflator tube. The power inflator tube 58 allows for gas in the tank to be used for filling the buoyancy compensator 10 by means of control valves on an inflator body 60. The inflator body 60 can have a control valve and attachment means for the tube 58 as seen at attachment means 62, as well as a control button 64 that controls the amount of pressurized gas that is delivered to the interior of the buoyancy compensator 10.

The foregoing configuration allows for a buoyancy compensator effect by the buoyancy compensator 10 so that various depths can be accommodated for as to the requirements of certain degrees of buoyancy. This allows for an increase or decrease of buoyancy depending upon the depth that a diver is at by either orally inflating the buoyancy compensator 10 through the mouthpiece 56 of the inflator tube or by means of pressing a button such as button 64 to permit the pressure in the tube 58 to be delivered to the interior of the buoyancy compensator.

The foregoing buoyancy compensator 10 can be formed with various configurations of two sided panels 18, 20, 22, 24 and 26 that incapsulate a bladder. In the alternative, it can be formed as a unitary buoyancy compensator without a bladder and merely has a gaseous non-permeable material incapsulating the buoyancy compensating pressure chamber within the buoyancy compensator 10. One way or the other, the expansion and contraction of the buoyancy compensator is accommodated for by the panels 22 and 24, as well as by the overall expansion and contraction of the cross sectional dimension of the left vest area or panel and right vest area or panel, as well as the back area or panel which has a cross sectional dimension shown between the interior and exterior portions thereof. This allows for the expansion and contraction of the buoyancy compensator when formed as a unitary gaseous non-permeable material or a reinforcing material with a gas containing bladder therein.

Looking more particularly at FIG. 1 in conjunction with the remaining figures, it can be seen that a belt formed as a webbed belt 66 has been shown. This is generally the same webbed belt of the prior art that is utilized with the buoyancy compensator and is looped through the loops thereof to strap the buoyancy compensator to a user. The webbed belt 66 has a buckle 68 with a handle 70 connecting the two ends thereof. The webbed belt handle 70 allows for adjustment of the webbed belt 66 to move inwardly and outwardly thereof, so that various dimensions of circumferential fit around a user's waist can be accommodated for. This particular webbed belt 66 can be one usually used with a buoyancy compensator or substituted in any other manner to allow for attachment of the expandable buoyancy compensator belt as described hereinafter.

Figure 2:
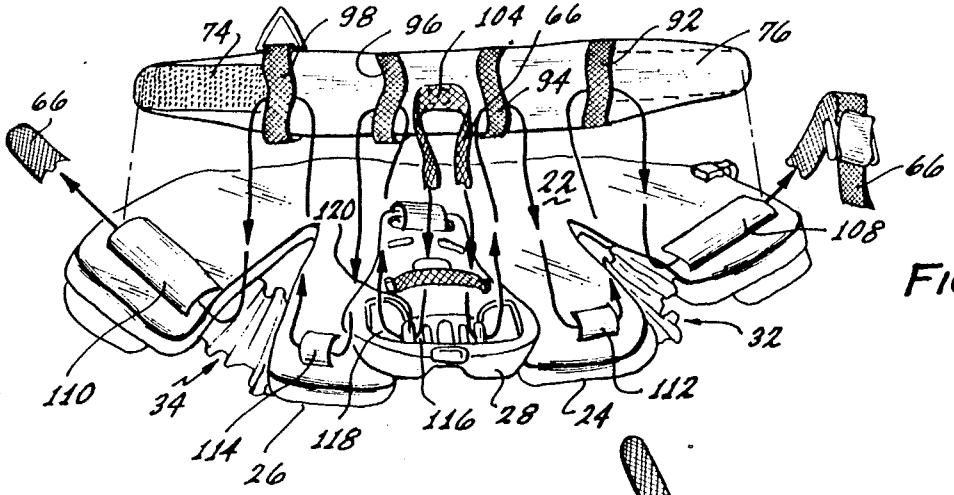
FIG. 2 shows a plan layout view of the buoyancy compensator belt as it is attached and connected to a buoyancy compensator and backpack.
Figure 3:
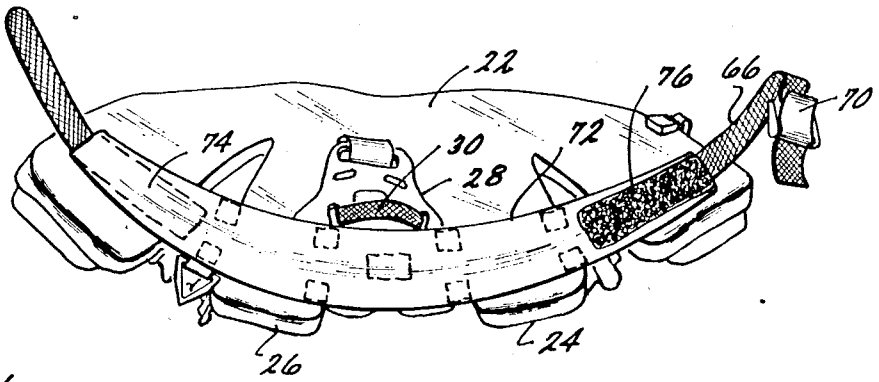
FIG. 3 shows a plan layout view of the buoyancy compensator belt when it is fully connected to a buoyancy compensator and is ready for use.
Figure 4:
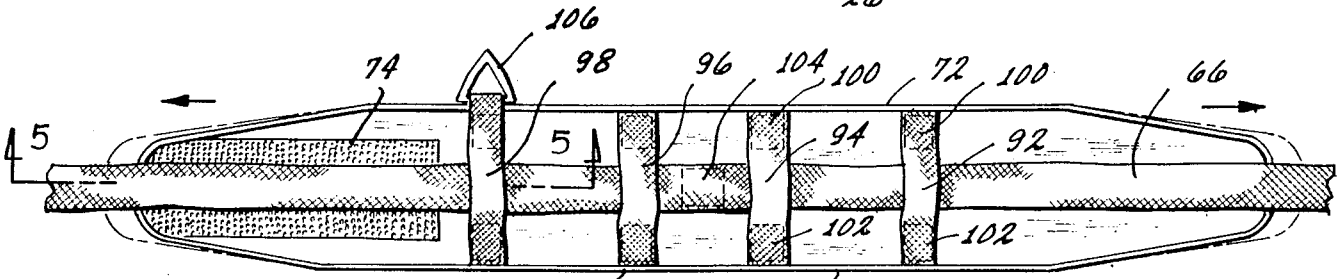
FIG. 4 shows an interior plan view of the buoyancy compensator belt of this invention with the dynamic nature of its expansion and contraction thereof.

Looking more particularly at FIG. 4, it can be seen that a wide buoyancy compensator belt 72 has been shown. The buoyancy compensator belt 72 is shown with a Velcro ® attachment means 74 which is formed from a series of small plastic hooks that engage a tufted material on the other end of the belt which is shown in dotted configuration in FIG. 2, and with the actual material 76 shown in FIG. 3. The tufted material 76 is of the type shown as that material which engages Velcro ® hooks to provide for an attachment of the Velcro ® hooks 74 to the tufted material 76. Both the Velcro ® hooks 74 and tufted material 76 engage each other in the manner that can be described by most Velcro® attachment means. The respective plastic hooks 74 and tufted material 76 are stitched by stitching to the main body portion of the buoyancy compensator belt 72.

The main body portion of the buoyancy compensator belt 72 is shown as an elastomeric main body portion 78 made from an elastomeric foamed expandable wetsuit material 80 that has an elastomeric nature thereto. The foamed elastomeric wetsuit material 80 is covered on either side by an elastomeric textile material 82 and 84. The elastomeric textile material is bonded to the foamed elastomeric wetsuit material 80 that has expanded cells therein. The elastomeric textile material is bonded in a process whereby it can be heatset, adhered, or attached in any other suitable manner, such as that known to the manufacturers of wetsuit material.

The buoyancy compensator belt 72 is stitched around the edge thereof by stitching 86 in the way of a binding stitching that in turn binds the edges thereof by a binding 88. The binding 88 not only secures the foamed elastomeric wetsuit material and the elastomeric textile materials 82 and 84, but also serves to secure an interior cloth material 90 which covers a portion of the buoyancy compensator belt 72 within the area close to a user's back area.

The buoyancy compensator belt 72 incorporates four webbed cross straps 92, 94, 96 and 98. The four webbed cross straps 92, 94, 96 and 98 are lateral straps that are stitched by means of stitching at either side, such as shown by stitching 100 and 102. The stitching 100 and 102 is similar to that used for the remaining straps. These particular straps 92 through 98 allow for the passage and maintenance of the webbed belt 66 connected thereto.

The webbed belt 66 is held therein and can be stitched at various locations to the buoyancy compensator belt 72 such as at rectangular stiching location 104. The rectangular stitching location 104 is such where it secures the webbed belt 66 to the buoyancy compensator belt 72 at that one particular location and allows it to pass under the webbed straps 92 through 98 that overlie it. Thus, the webbed straps 92 through 98 allow for flexibility and securement of the buoyancy compensator belt 72 to the buoyancy compensator 10 in a manner to allow for movement of the buoyancy compensator belt with respect to the interfacing relationship of the buoyancy compensator 10.

As can be seen, the buoyancy compensator belt 72 stretches longitudinally in the direction of the arrows shown longitudinally in either direction to accommodate for variances in circumferential dimension around a user. This provides for the expansion and contraction due to variances in pressure caused by different depths at which the buoyancy compensator 10 is used.

In order to accommodate for the use of other diving equipment, a triangular loop 106 is shown. The triangular loop 106 can hold various pieces of diving equipment. The triangular loop 106 is secured to the webbed strap 98 by means of passing through a depending portion thereof which is stitched over in order to hold the loop therein. The loop 106 can be made of plastic or any other suitable means. Furthermore, various loops, such as loop 106 can be attached to the webbed strap portions 92 through 98 or provided in any other suitable manner for the holding of depending attachment means to the buoyancy compensator belt 72.

This particular buoyancy compensator belt 72 has been shown attached to the buoyancy compensator 10 by means of the webbed belt 66. However, it can be attached by any other suitable means connecting it, so long as it is an expandable and contracting belt member to which the buoyancy compensator 10 is attached.

The buoyancy compensator belt 72 is also enhanced by virtue of the fact that it is able to be attached to the buoyancy compensator 10 as a retrofit through removal of the webbed belt 66 which is normally used therewith and replacing it in cooperation with the buoyancy compensator belt 72. In the alternative, the buoyancy compensator belt 72 can be used as an original piece of equipment attached to the buoyancy compensator without the use of the loops 92 through 98.

In this particular embodiment, as well as the alternatives, it has been shwon attached by means of the webbed belt 66. In order to attach the webbed belt 66 to the buoyancy compensator 10, it is shown passing through the backpack 28 and the buoyancy compensator, as well as the buoyancy compensator belt 72. The webbed belt 66 is threaded in a manner to be described hereinafter, but as previously stated, various other means can be utilized to attach the buoyancy compensator belt 72 to the buoyancy compensator 10.

In this particular embodiment, two major nylon webbed keepers respectively on the left and right sides as worn are shown. These comprise the left keeper 108 and the right keeper 110. The left and right keepers are formed as tubular members that are attached to the interior of the buoyancy compensator and are stitched thereto. Two minor tubular keepers, respectively keeper 112 and 114 are shown. These keepers 112 and 114 are minor keepers respectively on the left and right side.

The foregoing keepers 108 through 114 generally provide for the securement and attachment of the belt 66 that can be used with the buoyancy compensator 10 as in the prior art when the buoyancy compensator belt 72 of this invention is not used. However, in this particular embodiment, it is shown as a means for attaching the buoyancy compensator belt 72 to the buoyancy compensator 10. In addition to the keepers 108 through 114, the belt 66 is shown looped through small and large openings 116 and 118 of the backpack 28. The small section 116 is an opening of the backpack 28 through which the belt 66 can be looped downwardly and pass upwardly through the larger opening 118. The larger opening 118 and smaller opening 116 are divided by a cross member 120 of the backpack. This cross member 120 secures the belt 66 so that it is looped therethrough and passes upwardly through the respective webbed strap 96 and downwardly through the keeper 114 and upwardly through the webbed strap 98. The belt 66 then passes outwardly and through the keeper 110.

In like manner, the other end of the belt 66 with the buckle is initially passed through the buoyancy compensator backpack 28 at similar minor and major opening 116 and 118 divided by a cross member and then passed upwardly through web strap portion 94 and upwardly through keeper 112 and then through web strap portion 92 and outwardly through keeper 108. For purposes of convention, the arrows have been shown threading initially the webbed belt 66 in each direction of the arrows from one side to the other. If the buckle 68 is removed along with the handle 70, and there is no stitching 104 secured webbed belt 66 to the buoyancy compensator belt 72, the webbed belt can pass from one direction to the other in the manner as shown. It should also be kept in mind, that when the webbed belt 66 is attached by the rectangular stitching 104, it can only be passed from left to left and right to right because of the fact that the rectangular stitching 104 secures the webbed belt 66 from being disengaged from the buoyancy compensator belt 72 at the center.

As can be seen from the foregoing specification, the buoyancy compensator belt 72 can be attached to the buoyancy compensator by means of the keepers 108 through 114. This provides for flexibility and movement of the buoyancy compensator belt so that it can expand and contract in the direction of the arrows, as shown in FIG. 4.

It should be understood that any suitable means of attachment of the elastomeric buoyancy compensator belt 72 can be utilized for attaching it to a buoyancy compensator 10. Firstly, webs that are elastomeric in nature spanning between the buoyancy compensator 10 and the buoyancy compensator belt 72 can be utilized, as well as other securement means. It is desirable however, to maintain the flexibility between the buoyancy compensator 10 and the buoyancy compensator belt so that the belt can expand and contract while at the same time maintaining the buoyancy compensator around a user's body. This is due to the fact that the buoyancy compensator belt 72 should be allowed to expand and contract, depending upon the depth and the relative pressure that collapses or allows the foam of the buoyancy compensator belt 72 to expand or contract. Also, if the buoyancy compensator belt 72 is not made of a foam wetsuit material such as the foam expandable material 80 that comprises the main body portion 78, it should still be allowed to expand and contract as any elastomeric member. Furthermore, it should be allowed to expand and contract in conjunction with a diver's wetsuit which it overlies, so that it appropriately follows the expansion and contraction of the wetsuit.

The foregoing enhances and enables the buoyancy compensator belt 72 to move circumferentially around a diver and maintain a relationship with the diver in the same manner as the expansion coefficient of the wetsuit. Thus, the belt does not bind or prevent the movement as desired. As can be appreciated, the prior art webbed belts, such as webbed belt 66 which secures the buoyancy compensator belt 72 to the buoyancy compensator 10 would not expand or contract in this manner.

In addition to the foregoing attachment means of the buoyancy compensator belt 72 to the buoyancy compensator 10, various other means such as hooks, eyelets, straps, webs, elastomeric straps, or any other suitable means can be used to allow the buoyancy compensator 10 to be interconnected to the buoyancy compensator belt 72, while at the same time allowing it to expand and contract. The thought being that the buoyancy compensator belt 72 should not be directly adhered to the buoyancy compensator so that there is not give and play between the buoyancy compensator 10 and buoyancy compensator belt 72. Thus, there should be play or give between the two to allow for the expansion and contraction of the buoyancy compensator belt 72 to provide the net result of accommodating the expansion of the buoyancy compensator belt 72.

Various configurations of the buoyancy compensator belt 72 can be utilized whereby it can be formed as an integral portion of the buoyancy compensator 10, so that it is attached in a flexible manner to allow the expansion and contraction of the buoyancy compensator belt 72 or provided for in any suitable manner as set forth above. Accordingly, this invention should be read broadly in light of the combination of the buoyancy compensator belt 72, the buoyancy compensator 10 and the aspects pertaining thereto in a singular, as well as a combined form.

We claim:

1. The combination of a buoyancy compensator of the type wherein buoyancy is controlled by providing an increase or decrease of air and a belt for securing said buoyancy compensator to a diver comprising:

a buoyancy compensator having an interior side disposed toward a user's body;

said buoyancy compensator having a backpack connected thereto for receipt of a breathing gas tank wherein said buoyancy compensator has a left and a right front panel and a back panel establishing buoyancy compensation for a diver and wherein said left and right front buoyancy compensator panels are split from the back at least along a portion of the sides thereof;

a buoyancy compensator belt comprised of an elastomeric material formed of elastomeric foam and with a fabric bonded to the surface thereof that can allow the expansion and contraction thereof around a diver's waist;

said buoyancy compensator belt is detachably connected at its ends by means of an attachment means formed from a plastic pile and a multiplicity of hooks for connection to said pile, respectively at each end of said buoyancy compensator belt;

said buoyancy compensator belt being connected to said buoyancy compensator by connection means comprising:

a strap member attached to said buoyancy compensator belt;

means for receiving said strap member from said buoyancy compensator belt on the interior side of said buoyancy compensator so as to allow for give between the buoyancy compensator belt and said strap member; and, attachment means at the end of said strap member for attaching the ends of said strap member together.

2. The combination as claimed in claim 1 wherein:

said buoyancy compensator between the left and right front panel and the back panel at the splits is interconnected by means of an expandable connection means between the left and right front panel and back panel.

3. The combination as claimed in claim 1 further comprising:

a plurality of looped keepers connected to the interior of said buoyancy compensator for receiving said strap member; and, a plurality of loops on said buoyancy compensator belt through which said strap member passes and which is turn in connected through said keepers.

4. The combination as claimed in claim 3 wherein:

said connection means between said left and right front panels to said back panel comprise an elastomeric panel underlying the area where the arms of a diver pass through said buoyancy compensator; and further comprising, a backpack connected to said buoyancy compensator through which the stap member of said buoyancy compensator belt passes for connection thereto; and, said attachment means for attaching the ends of said strap together is in the form of a buckle and handle means.

5. A buoyancy compensator belt for use with a buoyancy compensator comprising:

a belt for circumscribing a user's waist formed of an elastomeric material substantially similar to wetsuit material for a diver;

said belt having at the ends thereof a looped pile material on one end thereof and a multiplicity of hooks at the other end for being received on said looped pile material for detachably connecting the ends of said belt to each other in order to circumscribe a user's waist;

strap means connected to said belt;

a plurality of looped keepers connected to said buoyancy compensator for receiving said strap on said buoyancy compensator for connecting said belt to said buoyancy compensator;

means for connecting the ends of said strap means that interconnect said belt to said buoyancy compensator in the form of a buckle and handle means.

6. The buoyancy compensator belt as claimed in claim 5 further comprising:

elastomeric material formed with cells and having a fabric adhered to the surface thereof; and, loops for connecting said strap means to said buoyancy compensator belt to allow give between said buoyancy compensator belt and said buoyancy compensator.

* * * * *